US007524204B2

(12) United States Patent
Shimada et al.

(10) Patent No.: US 7,524,204 B2
(45) Date of Patent: Apr. 28, 2009

(54) ELECTRIC CONNECTOR

(75) Inventors: Yoshinobu Shimada, Tokyo (JP); Jin Tateishi, Tokyo (JP)

(73) Assignee: I-PEX Co., Ltd, Tokyo (JP)

( * ) Notice: Subject to any disclaimer, the term of this patent is extended or adjusted under 35 U.S.C. 154(b) by 0 days.

(21) Appl. No.: 11/484,990

(22) Filed: Jul. 11, 2006

(65) Prior Publication Data

US 2007/0044404 A1 Mar. 1, 2007

(30) Foreign Application Priority Data

Jul. 21, 2005 (JP) ..... 2005-211831

(51) Int. Cl.
*H01R 13/62* (2006.01)

(52) U.S. Cl. ..... 439/260; 439/495

(58) Field of Classification Search ..... 439/260, 439/267, 494–497

See application file for complete search history.

(56) References Cited

U.S. PATENT DOCUMENTS

| | | | | |
|---|---|---|---|---|
| 5,240,430 | A * | 8/1993 | Soes | 439/260 |
| 5,906,498 | A * | 5/1999 | Nagafuji | 439/260 |
| 6,383,017 | B1 * | 5/2002 | Takayasu | 439/495 |
| 6,726,497 | B2 * | 4/2004 | Nogawa et al. | 439/260 |
| 6,837,740 | B2 * | 1/2005 | Kunishi et al. | 439/495 |
| 7,086,884 | B2 * | 8/2006 | Okano | 439/260 |
| 7,147,498 | B1 * | 12/2006 | Gillespie et al. | 439/260 |
| 7,172,446 | B1 * | 2/2007 | Hashimoto et al. | 439/260 |
| 7,361,042 | B2 * | 4/2008 | Hashimoto et al. | 439/260 |
| 2004/0023551 | A1 * | 2/2004 | Suzuki et al. | 439/495 |
| 2005/0136732 | A1 * | 6/2005 | Suzuki | 439/495 |
| 2005/0255732 | A1 * | 11/2005 | Sunaga | 439/260 |
| 2006/0084311 | A1 * | 4/2006 | Suzuki et al. | 439/260 |
| 2006/0110965 | A1 * | 5/2006 | Koga | 439/260 |
| 2007/0093122 | A1 * | 4/2007 | Kudo et al. | 439/495 |

FOREIGN PATENT DOCUMENTS

| | | |
|---|---|---|
| JP | 3047862 | 2/1991 |
| JP | 3101951 | 4/1991 |
| JP | 11-307198 | 11/1999 |

* cited by examiner

*Primary Examiner*—Renee S Luebke
*Assistant Examiner*—Larisa Tsukerman
(74) *Attorney, Agent, or Firm*—Reed Smith LLP

(57) ABSTRACT

A coupling spring portion 15 connecting a movable beam 13 and a fixed beam 14 is formed in a shape of extending toward a connector rear end in a curved manner, so that, even if a joined portion of the coupling spring portion 15 is disposed at an approximately central portion of the fixed beam 14, an insertion space for a connection object is secured sufficiently. Simultaneously, a distance X from a swinging center W of the movable beam 13 to a front side contact point 13*a* of the movable beam 13 and a distance Y there from to an actuator operating point Q are set to be approximately equal to each other, so that a contact pressure of the movable beam 13 to the connection object is kept approximately constant by causing an operation amount of the actuator 16 to the movable beam 13 and a working amount of the movable beam 13 at the front side contact point 13*a* to approximately coincide with each other.

4 Claims, 3 Drawing Sheets

【Fig. 1】
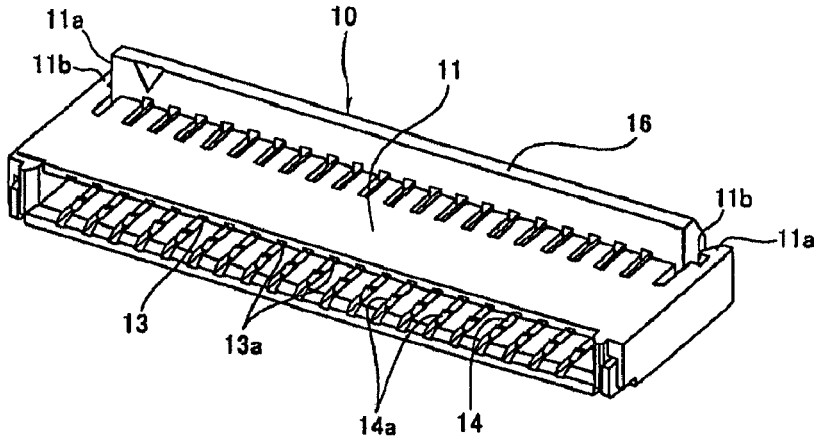
【Fig. 2】
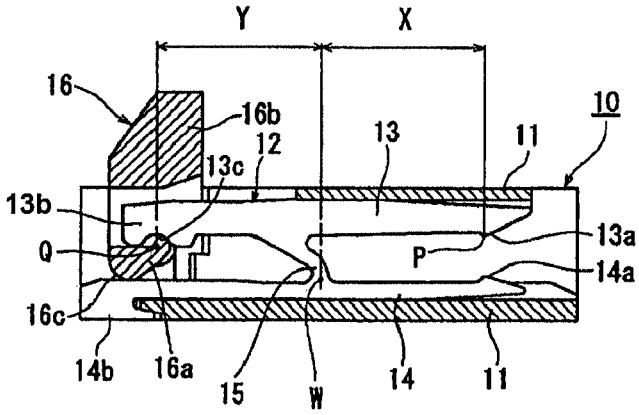

【Fig. 3】
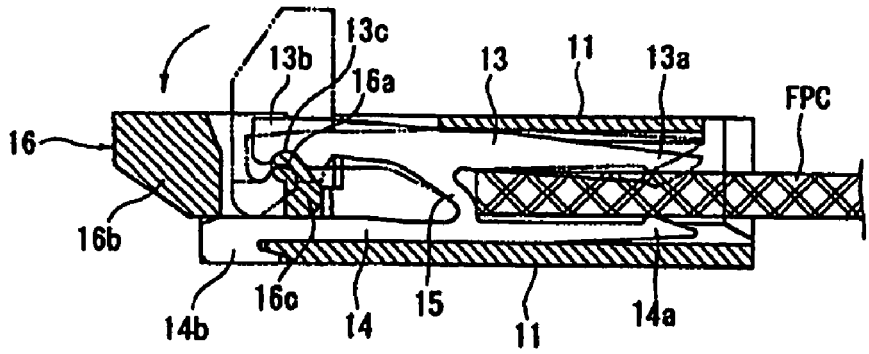
【Fig. 4】
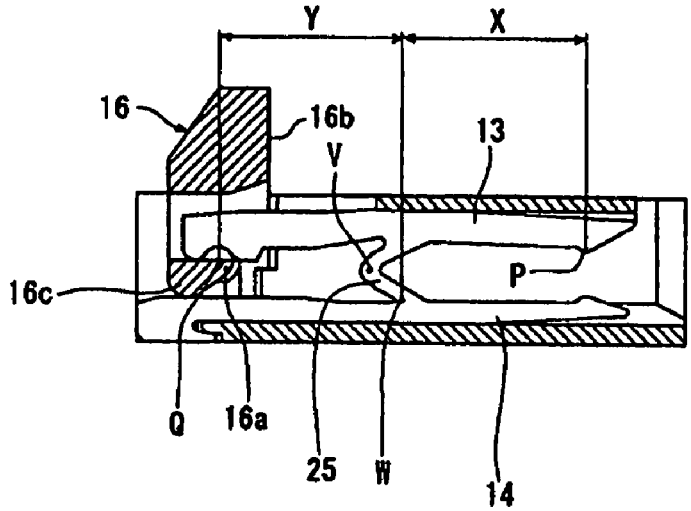
【Fig. 5】
Prior Art
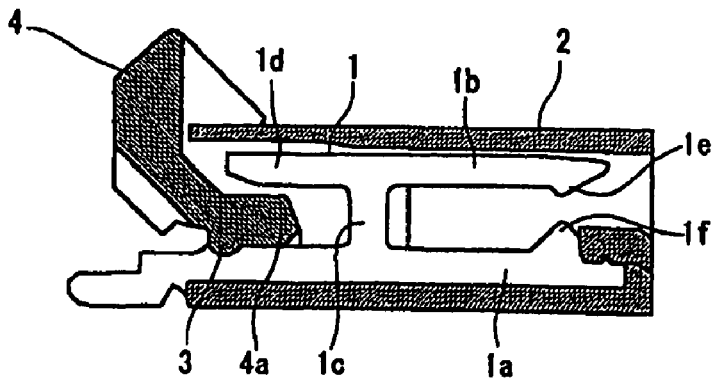

【Fig. 6】
Prior Art
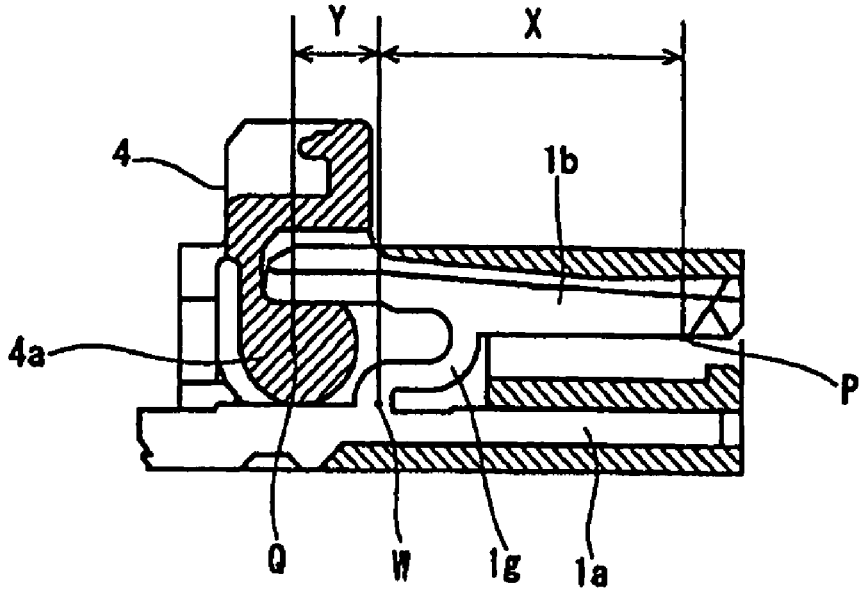

ELECTRIC CONNECTOR

BACKGROUND OF THE INVENTION

1. Field of the Invention

The present invention relates to an electric connector that connects a flexible wiring substrate (FPC), a flexible flat cable (FFC), or the like.

2. Description of the Related Art

As one example of an electric connector of this type, connectors for FPC described in Patent Literature 1 and Patent Literature 2 described below have been known. In a connector for FPC shown in FIG. 5, for example, many flat metal contacts (electrically conductive terminals) with an approximately H shape 1 are attached within a hollow insulating housing 2 in a row manner at proper small pitch, and an actuator 4 is pivotally attached to a rear end of the insulating housing 2 via a pivoting shaft 3.

At that time, each of the above-described contacts 1 has a fixed beam 1*a* and a movable beam 1*b* extending in an insertion direction of an FPC which is a connection object, or an object to be connected, (not shown), and the movable beam 1*b* disposed on an upper side in FIG. 5 is swingably connected to the fixed beam 1*a* via a coupling spring portion 1*c*. When a portion to be operated 1*d* provided on a rear end portion of the movable beam 1*b* is deformed elastically so as to be lifted up according to pivoting of a cam portion 4*a* provided on the actuator 4, a contact portion 1*e* provided on a front end portion of the movable beam 1*b* is pushed on the FPC which is the connection object so that the FPC is clamped between a contact portion 1*f* of the fixed beam 1*a* and the contact portion 1*e*.

In such a conventional electric connector, however, the coupling spring portion 1*c* joining the fixed beam 1*a* and the movable beam 1*b* to each other is formed in a straight shape connecting the both the beams 1*a* and 1*b* to each other approximately linearly. Therefore, according to advance of thinning or height reducing of an electric connector in recent years, a span length of the coupling spring portion 1*c* having a straight shape is shortened correspondingly. As a result, deformation stress generated when the movable beam 1*b* is displaced so as to be connected with a connection object such as an FPC concentrates on the coupling spring portion 1*c* and the coupling spring portion 1*c* plastically deforms, which may result in loss in required elasticity.

In view of these circumstances, in an electric connector shown in FIG. 6, for example, a constitution that a span length is elongated by bending a coupling spring portion 1*g* in a crank shape is adopted, so that concentration of deformation stress such as described above is avoided (see Patent Literature 3 described below). In an electric connector adopting such a constitution, however, since the coupling spring portion 1*g* extending from a fixed beam 1*a* is formed so as to extend toward a connector front end (a right side in FIG. 6) inserted with a connection object such as an FPC, an arrangement space for the coupling spring portion 1*g* is expanded and a length of a portion to which a connection object such as an FPC is inserted is shortened, which results in a problem that an insertion guide length and an effective fitting length of a connection object become insufficient.

In the electric connector shown in FIG. 6 and described above, therefore, an insertion space of a connection object is secured by biasing an arrangement position of the coupling spring portion 1*g* toward a connector rear end (a left side in FIG. 6). In such a constitution, however, a distance X from a swinging center W of the movable beam 1*b* to an FPC contact point P on a front end side is considerably larger than a distance Y from the same swinging center W to an actuator operating point Q that is a pivoting center of an actuator 3 (X>Y). Therefore, a working amount at the FPC contact point P of the movable beam 1*b* to an operation amount of the actuator 3 is largely expanded. As a result, large fluctuation in a contact pressure of the movable beam 1*b* to an FPC occurs, which may result in lowering in reliability of the electric connector.

It is thought that the distance X to the FPC contact point P and the distance Y to the actuator operating point Q are set to be approximately equal to each other by setting the swing center W of the movable beam 1*b* to an approximately central position of the fixed beam 1*a* (X≅Y). In that case, however, the insertion space for a connection object can not be secured, as described above. Otherwise, the connector must be extended in an insertion direction of the connection object in order to secure the insertion space for a connection object, which results in large-sizing of the connector.

In the conventional electric connector, as shown in FIG. 5, since the fixed beam 1*a* is attached to the insulating housing 2 in a completely fixed state, when a connection object such as, for example, an FPC is applied with a deformation force acting upward in FIG. 5, the movable beam 1*b* also elastically deforms upwardly following the connection object such as an FPC. However, since the fixed beam 1*a* is fixed to the insulating housing 2 and it is not deformed, a contact pressure to the connection object becomes unstable due to separation of the contact portion 1*f* at a distal end thereof from the connection object such as an FPC. Particularly, when the connection object is a lower contact, electrical conduction may be shut off instantaneously.

Patent Literature 1: Japanese Patent No. 3047862

Patent Literature 2: Japanese Patent No. 3101951

Patent Literature 3: JP-A-11-307198

An object of the present invention is to provide an electric connector which can maintain an excellent contact state of a movable beam and a fixed beam to a connection object such as an FPC utilizing a simple structure.

SUMMARY OF THE INVENTION

In order to achieve the above object, an electric connector according to the present invention is an electric connector including a contact having a fixed beam and a movable beam which extend in an insertion direction of a connection object, an insulating housing which holds the contact internally, and an actuator which is positioned on an opposite side from insertion of the connection object and elastically deforms the contact so as to bring the contact in contact with the connection object, where the movable beam of the contact is swingably supported via a coupling spring portion joining the movable beam and the fixed beam, wherein the coupling spring portion has a shape of extending in a curved manner from a joined portion thereof with the fixed beam toward a connector rear end which corresponds to a direction in which the connection object is inserted.

According to the electrical connector with such a constitution, even if the joined portion of the coupling spring portion extending from the fixed beam is arranged at an approximately central portion of the fixed beam, since the coupling spring portion extends toward the rear end of the connector corresponding to the insertion direction of the connection object, an insertion space for the connection object ahead of the coupling spring portion can be secured sufficiently. Since a distance from a swinging center of the movable beam which is the joined portion of the coupling spring portion to the fixed beam to the front side contact point of the movable beam is approximately equal to a distance to the actuator operation point, an operation amount of the actuator to the movable beam approximately conforms with a working amount of the movable beam at the front side contact point, so that a contact pressure of the movable beam to the connection object is kept approximately constant.

In the electric connector according to the present invention, since the contact portion of the fixed beam is formed so as to elastically deform relative to the connection object, even if an FPC is displaced so as to be pressurized in a direction in which the FPC is separated from the fixed beam, electric conductivity between the contact portion of the fixed beam and the connection object is kept excellent.

As described above, the electric connector according to the present invention, since such a constitution is adopted that the coupling spring portion connecting the movable beam and the fixed beam is formed in a shape of extending from the joined portion with the fixed beam toward the rear end of the connector in the bending manner, even if the joined portion of the coupling spring portion is disposed at an approximately central portion of the fixed beam, an insertion space for the connection object ahead of the coupling spring space can be secured sufficiently and the distance from the swinging center of the movable beam to the front side contact point of the movable beam and the distance to the actuator operation point are set to be approximately equal to each other, and the operation amount of the actuator to the movable beam and the working amount of the movable beam at the front side contact point are caused to approximately coincide with each other, so that a contact pressure of the movable beam to the connection object is kept approximately constant, contact states of the movable beam and the fixed beam to such a connection object such as an FPC can be kept excellent with a small-sized and simple structure, so that reliability of the electric connector can be considerably improved at a low cost.

BRIEF DESCRIPTION OF THE DRAWINGS

FIG. 1 is an appearance perspective explanatory view showing a released state of an actuator in an electric connector for an FPC according to an embodiment of the present invention;

FIG. 2 is a cross-sectional explanatory view showing a cross-sectional shape of the electric connector for an FPC shown in FIG. 1 in an enlarged manner;

FIG. 3 is a cross-sectional explanatory view showing an activating state of the actuator in the electric connector for an FPC shown in FIG. 2;

FIG. 4 is a cross-sectional explanatory view showing a released state of an actuator in an electric connector for an FPC according to another embodiment of the present invention;

FIG. 5 is across-sectional explanatory view of an electric connector for an FPC according to a conventional example; and FIG. 6 is a cross-sectional explanatory view of an electric connector for an FPC according to another conventional example.

BEST MODE FOR CARRYING OUT THE INVENTION

Embodiments of the present invention will be explained below in detail with reference to the drawings.

An electric connector for an FPC 10 according to an embodiment of the present invention shown in FIGS. 1, 2, and 3 includes a hollow insulating housing 11 extending in an elongated shape, and many contacts (electrically conductive terminals) 12 formed of metal members are accommodated inside the insulating housing 11 in a widthwise direction (a longitudinal direction) at proper pitches in a row manner. As shown in FIG. 1, the insulating housing 11 is provided at both ends in its longitudinal direction on its depth side (an upper side in FIG. 1) with projecting portions 11*a* and 11*a*, and an actuator 16 is disposed in a space portion formed in an elongated shape at a central portion of the insulating housing in a longitudinal direction thereof.

Each of the contacts 12 has a pair of movable beam 13 and a fixed beam 14 extending from a front end (a right side in FIG. 3) of the connector through which an FPC (see FIG. 3) which is a connection object described later is inserted toward a rear end (a left side in FIG. 3) thereof. The movable beam 13 and the fixed beam 14 are arranged such that they face each other above and below in an inner space of the insulating housing 11, both the beams 13 and 14 are coupled to each other by a coupling spring portion 15.

The fixed beam 14 described above is attached to a bottom portion of the insulating housing 11 in a fixed state. Specifically, in the fixed beam 14, dimple forming or the like is performed on a joined portion of the coupling spring portion 15 and the fixed beam 14 or on a connector rear end (on a left side in FIG. 3) in a thickness direction of the contact 12, so that the fixed beam 14 is fixed so as to deform partially. A contact projecting portion 14*a* connected to an electrically conductive path (not shown) of the FPC which is the connection object is provided at a connector front end (on a right side in FIG. 3) of the fixed beam 14 so as to project upwardly in FIG. 2. The contact projecting portion 14*a* of the fixed beam 14 is provided so as to warp slightly upwardly toward the front end of the connector (on a right side in FIG. 2), and the upwardly warping portion is constituted so as to elastically displace as a free end slightly spaced from the bottom face of the insulating housing 11. A connecting terminal portion 14*b* connected to a printed circuit board by soldering (not shown) is provided at a connector rear end (on the left side in FIG. 3) of the fixed beam 14.

On the other hand, the above-described movable beam 13 is joined to the fixed beam 14 via the coupling spring portion 15 so as to be swingable relative to the fixed beam 14. A structure of the coupling spring portion 15 will be described later, but a contact projecting portion 13*a* connected to an electrically conductive path (not shown) of the FPC (see FIG. 3) is provided at the connector front end (on the right side in FIG. 3) of the movable beam 13 so as to project downwardly in FIG. 3, and the contact projecting portion 13*a* is constituted to clamp the FPC from above and below in cooperation with the contact projecting portion 14*a* of the above-described fixed beam 14.

A portion to be worked 13*b* to the actuator 16 is provided on a connector rear end (on the left side in FIG. 3) of the above-described movable beam 13. The actuator 16 is formed of an elongated plate-like member, and both end portions of a pivoting shaft 16*a* in an axial direction thereof arranged along the portion to be worked 13*b* are rotatably supported to the connector rear end (on the left side in FIG. 2) of the insulating housing 11, so that the entire actuator 16 is pivotally arranged about the pivoting shaft 16*a*. Specifically, projecting portions (not shown) are provided at a position of the pivoting shaft 16*a* on both ends of the actuator 16 in the longitudinal direction thereof and groove-shaped portions 11*b* are provided on inner faces of both the projecting portions 11*a* of the insulating housing 11 so that the actuator 16 is supported by fitting the projecting portions into the groove-shaped portions 11*b*. The actuator 16 thus constituted is constituted to be pivotally operated between a releasing position where it stands erect to a upper face of the insulating housing 11, as shown in FIG. 2, and a working position where it falls over approximately horizontally to the upper face of the insulating housing 11, as shown in FIG. 3.

A bearing portion 13*c* provided on the portion to be worked 13*b* of the movable beams 13 described above so as to be recessed in an approximately semi-circular shape is caused to slidably abut on an upper half portion shown of the pivoting shaft 16*a* of the actuator 16 so as to cover the upper half portion from above.

The above-described actuator 16 has an operation portion 16*b* extending from the pivoting shaft 16*a* toward the outside of the connector and a cam portion 16*c* extending from the pivoting shaft 16*a* opposite from the operation portion 16*b*, and an outer peripheral surface of the cam portion 16*c* is put in an arrangement relationship where it contacts with and slides on an inner bottom face of the insulating housing 11. When an operator or a user grasps the above-described operation portion 16*b* with his/her hand to pivot the actuator 16 from the releasing position shown in FIG. 2 toward the working position shown in FIG. 3, a pivoting radius of the cam portion 16*c* changes to increase so that the portion to be worked 13*b* of the movable beam 13 is displaced so as to be lifted upwardly, as shown in FIG. 3 according to a diameter change. Thereby, the portion to be worked 13*b* of the movable beam 13 is pushed upwardly, and the contact projecting portion 13*a* provided on the opposite side (the connector front end side) from the portion to be worked 13*b* is pressed downwardly so that the FPC is clamped between the contact projecting portion 14*a* of the above-described fixed beam 14 and the contact projecting portion 13*a*.

The movable beam 13 is constituted to be swung relative to the fixed beam 14 in this manner, but the swinging center W of the movable beam 13 is positioned at the joined portion of the coupling spring portion 15 and the fixed beam 14. As shown in FIG. 2, especially, the above-described swinging center W positioned at the joined portion of the coupling spring portion 15 and the fixed beam 14 is arranged so as to be positioned at an approximately central portion of the fixed beam 14 in an extending direction thereof, and a distance X from the swinging center W of the movable beam 13 to an FPC contact point P of the contact projecting portion 13*a* arranged on a connector front end of the movable beam 13 and a distance Y from the swingingcenter W to an actuator operating point Q which is an axial center of the pivoting shaft 16*a* of the described-above actuator 16 are set to be approximately equal to each other (X≅Y).

In the embodiment, the coupling spring portion 15 extending from the joined portion with the fixed beam 14 including the swinging center W is formed in a shape of extending toward the movable beam 13 in an approximately crank shape. More specifically, the coupling spring portion 15 extends from the joined portion with the fixed beam 14 toward the connector rear end (on the left side in FIG. 2) corresponding to an insertion direction of an FPC which is the connection object in a curved manner. The joined portion of the coupling spring portion 15 and the fixed beam 14 is formed so as to have a relatively narrow plate width. With such a constitution, the joined portion and a portion extending from the joined portion are increased in elasticity so that smooth displacement can be achieved.

The coupling spring portion 15 extending from the joined portion with the fixed beam 14 toward the connector rear end (the left side in FIG. 2) in a curved manner is formed to extend toward the movable beam 13 in an obliquely upwardly curved manner and join the movable beam 13 in such a changing manner as to form a relatively large plate width.

In the electric connector according to the embodiment, the joined portion of the coupling spring portion 15 extending from the fixed beam 14 toward the movable beam 13 and the fixed beam 14 is disposed at an approximately central portion of the fixed beam 14, but since the coupling spring portion 15 extends toward the connector rear end, an insertion space for an FPC which is the connection object can be obtained sufficiently, so that a guide length and an effective fitting length at an FPC inserting time can be secured sufficiently.

Since the distance X from the swinging center W positioned in the joined portion of the coupling spring portion 15 to the fixed beam 14 to the FPC contact point P at the front portion of the movable beam 13 and the distance Y therefrom to the actuator operating point Q of the movable beam 13 are set to be approximately equal to each other (X≅Y), the operation amount of the actuator 16 to the movable beam 13 and the working amount of the movable beam 13 at the FPC contact point P at the front portion of the movable beam 13 approximately coincide with each other, and a contact pressure of the movable beam 13 to the FPC which is the connection object is kept approximately constant, so that fluctuation in contact pressure occurring in the conventional art can be reduced.

In the electric connector according to the embodiment, since the contact projecting portion 14*a* of the fixed beam 14 is formed so as to be capable of displacing elastically relative to the FPC which is the connection object, even if the FPC which is the connection object is displaced to being swung in a direction of separating from the fixed beam 14, electrically conductive property between the contact projecting portion 14*a* of the fixed beam 14 and the FPC can be kept excellent. A portion of the contact projecting portion 14*a* of the fixed beam 14 positioned between the joined portion of the coupling spring portion 15 and the fixed beam 14, and the connector front end (on the right side in FIG. 3) may be formed to have a relatively narrow plate width.

In another embodiment shown in FIG. 4, where the same portions and parts as those in the above-described embodiment are denoted by same reference numerals in the above-described embodiment, a coupling spring portion 25 extending from the swinging center W of the movable beam 13 toward the movable beam 13 is formed in an approximately V shape. More specifically, the coupling spring portion 25 in the embodiment is formed such that the joined portion to the fixed beam 14 has a relatively narrow width and extends obliquely upwardly to curve from the joined portion with the fixed beam 14 toward the connector rear end (the left side in FIG. 4), it is then folded so as to be reversed to the connector front end (the right side in FIG. 4), and it extends obliquely upwardly as it is to be coupled to the movable beam 13 to form a relatively wide joined portion thereto. Even in the embodiment including such an approximately V-shaped coupling spring portion 25, function and advantage similar to those in the above-described embodiment can be obtained, and when the actuator 16 is pivoted to the working position, elasticity in not only the swinging center W of the movable beam 13 but also an approximately V-shaped crossing point V is increased, which is desirable.

Though the present invention which has been made by the present inventor(s) have been specifically explained regarding the embodiments, the present invention is not limited to the above embodiments, and it may be modified variously without departing from the gist of the present invention, of course.

In the above embodiments, for example, though the present invention has been applied to the electric connector for an FPC of a type where the actuator 16 is pivoted, it is not limited to the electric connector for an FPC and it may be similarly applied to electric connectors in which various connection objects except for the FPC are inserted. Further, the present invention can be similarly applied to an electric connector including an actuator (a slider) linearly moved between a releasing position and a working position.

In the embodiments, though a case that both upper and lower contact points are provided as the contact point for the contact has been explained, an aspect that either one of an upper and a lower sides of a contact is provided can be adopted, of course.

INDUSTRIAL APPLICABILITY

The present invention can be widely applied to various electric connectors used in various electric appliances.

What is claimed is:

1. An electric connector comprising:

a contact having a fixed beam and a movable beam which extend in an insertion direction of a connection object;

an insulating housing which holds the contact internally; and an actuator which is positioned on an opposite side from insertion of the connection object and elastically deforms the contact so as to bring the contact in contact with the connection object, wherein the movable beam of the contact is swingably supported via a coupling spring portion joining the movable beam and the fixed beam integrally, wherein the coupling spring portion has a shape of extending in a curved manner from a joined portion thereof with the fixed beam toward a connector rear end which corresponds to a direction in which the connection object is inserted so that an insertion space for the connection object is obtained, wherein the fixed beam extends integrally from (1) a connector rear end having a connecting terminal portion connected to a printed circuit board by soldering to (2) a connector front end having a contact portion which contacts the connection object, wherein the fixed beam is attached to a bottom portion of the insulating housing such that (1) the connector rear end is provided in a fixed state from the connecting terminal portion to a joined portion of the coupling spring portion, and (2) the connector front end is provided so as to warp upwardly from the joined portion of the coupling spring to the contact portion thereby creating a space between the contact portion and the bottom portion of the insulating housing, and wherein a curved shape of the coupling spring portion is formed in an approximately crank shape or an approximately V shape.

2. An electric connector according to claim 1, wherein the contact portion of the fixed beam abutting on the connection object is attached to a bottom portion of the insulating housing to be elastically deformable to the insulating housing.

3. An electric connector according to claim 1, wherein a distance from a swinging center of the movable beam to a contact portion abutting on the connection object and a distance from the swinging center of the movable beam to an operating portion of the actuator are set to be equal to each other.

4. An electric connector according to one of claims 1 or 3, wherein the actuator comprises a pivoting shaft positioned at a center thereof, an operation portion extending from the pivoting shaft toward the outside of the connector, and a cam portion extending from the pivoting shaft to an opposite side from the operation portion, where, according to operation of the operation portion about the pivoting shaft, the cam portion is pivoted and the movable beam of the contact is swung by the cam portion, so that the contact and the connection object are brought in contact with each other.

* * * * *